US008282193B2

(12) United States Patent
Brookfield et al.

(10) Patent No.: US 8,282,193 B2
(45) Date of Patent: Oct. 9, 2012

(54) OPTIMIZATON OF DOT PLACEMENT FOR THERMAL DRIFT

(75) Inventors: John Milton Brookfield, Newberg, OR (US); Jaclyn Nha Danh, Camas, WA (US); Kenneth Ralph Chamberlain, Oregon City, OR (AL); Russell Watt, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 296 days.

(21) Appl. No.: 12/730,138

(22) Filed: Mar. 23, 2010

(65) Prior Publication Data

US 2011/0234670 A1 Sep. 29, 2011

(51) Int. Cl.
*B41J 2/15* (2006.01)
*B41J 2/145* (2006.01)

(52) U.S. Cl. ..... 347/40; 347/43; 347/68

(58) Field of Classification Search ..... 347/5, 9, 347/12, 14, 19, 40–43
See application file for complete search history.

(56) References Cited

U.S. PATENT DOCUMENTS 6,969,146 B2 * 11/2005 Brookfield et al. ..... 347/40
* cited by examiner

*Primary Examiner* — Juanita D Jackson
(74) *Attorney, Agent, or Firm* — Marger Johnson & McCollom, P.C.

(57) ABSTRACT

A method of printing executes a software instruction using a print system controller to measure a vertical position of each row of an array of jets, having at least one offset subset of the array offset in a movement direction, adjusts timing of firing intervals for the offset subset such that the offset subset fire after a longer interval than other jets, and fires jets other than the offset subset at a predetermined firing interval. A print head has an array of transducers, an ink chamber to store ink arranged adjacent the array of transducers, and an array of jets arranged adjacent the ink chamber such that when selected ones of the array of transducers are activated, ink from the chamber exits a jet corresponding to the selected ones of the transducers, the array of jets having at least one subset of the array offset in a vertical direction relative to the other jets. A print system has a print head having an array of jets through which ink can be emitted, the array of jets having at least one subset of the array offset in a vertical direction relative to the other rows, an array of transducers arranged adjacent the array of jets to cause the jets to emit ink when activated, and a controller electrically coupled to the array of transducers to control the activation of the transducers.

18 Claims, 4 Drawing Sheets

OPTIMIZATON OF DOT PLACEMENT FOR THERMAL DRIFT

BACKGROUND

Ink jet printers generally use an array of jets, which may also be referred to as drop emitters or nozzles. As the printing surface passes the array, or the array passes over the printing surface, the jets drop ink onto it, forming an image. The drop of ink is typically forced out of the jet or aperture by activation of an electromechanical transducer. The transducer receives an activation signal at the correct time, and it actuates to force the ink out of the apertures.

The drops then fall onto the printing substrate in a pattern determined by the activation signals received by the transducers, the patterns of the drop ultimately form the printed image. In some printers, the printing surface is the paper or other print surface that is the final surface upon which the image is formed. In other printers, the printing surface is an intermediate transfer surface, such as a drum or a belt, from which the image is then transferred to the final print surface. In either case, the timing of the activation of the jets determines the positions in which the drops fall on the printing surface.

In some printers, an effect exists that causes a subset of the jet array, such as the outer row or rows of jets, single jets, groups of jets in a particular area, edge jets, etc. to slow down over the initial months of use at operating temperatures. The velocity of the jet in its flight from the print head to the printing surface slows. Due to the movement between the printing surface and the jet array, this causes a drift in the dot position, degrading the overall print quality. This degradation or print quality may result in service calls because of fuzzy or blurred edges and lines in the printed images, requiring printhead replacement, or other action to remedy the issue.

DETAILED DESCRIPTION OF THE EMBODIMENTS

Figure 1:
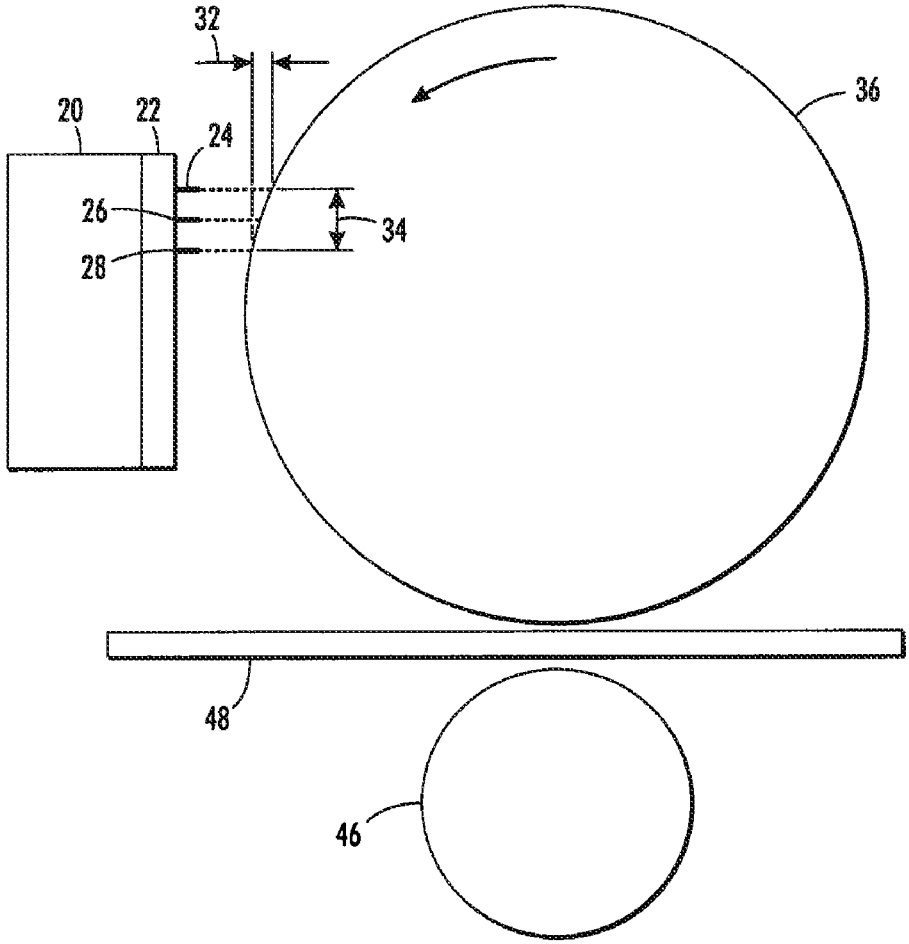
FIG. 1 shows an embodiment of a printing system having an array of jets.

FIG. 1 shows an embodiment of a printing system. This embodiment is an indirect printing system, meaning that the print head 20 prints onto an intermediate transfer surface 36. In this embodiment, the intermediate transfer surface 36 rotates in the direction of the arrow shown, passing the transfer surface past the print head 20. The transfer, or print, surface is brought into contact with the final print surface, or substrate, 48, by the transfix roller 46.

This is merely an example of a printing system. Other variations exist. For example, the print head may move relative to the printing surface, with the printing surface fixed in place. Alternatively, the printing system may be a direct printing system, where the print head prints directly onto the final printing substrate. Any discussion of particular examples here is not intended to limit the scope of the claims and no such limitation should be assumed.

In FIG. 1, the print head 20 has an array 22 of jets, nozzles or apertures, which emit ink drops onto the print surface. These jets are generally arranged in rows. In the embodiment shown in FIG. 1, three rows of jets are shown, with the understanding that the print head may have several more rows. The first row of jets 24 at the top of the array of jets will print first as the drum moves down relative to the print head. The second row of jets 26 and the third row of jets 28 print later after the drum has moved.

Figure 2:
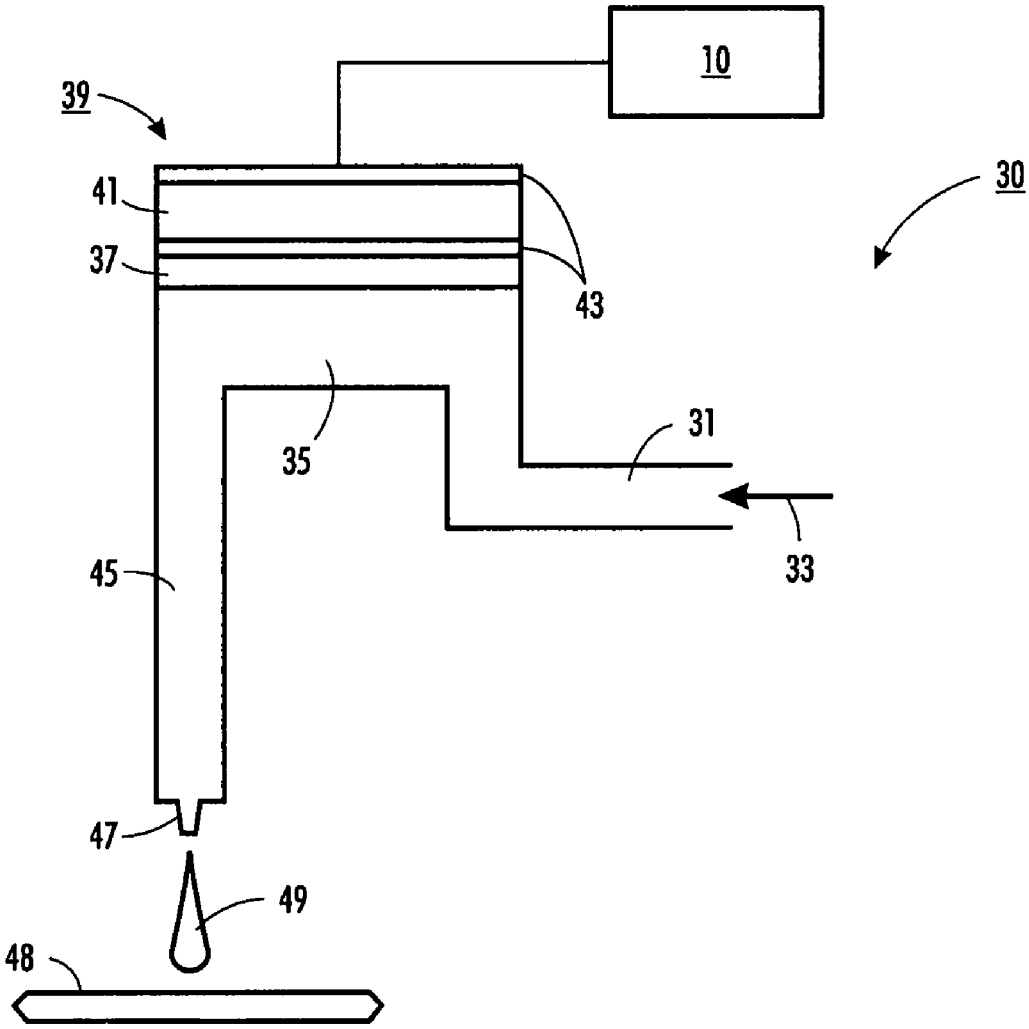
FIG. 2 shows an embodiment of a print head.

The distance 34 is the height different of the array of jets between the first and third rows. The distance 32 is the distance difference between how far the first row of ink drops from the first row of jets travels to contact the printing surface and how far the third row of ink drops from the third row of jets travels to contact the printing surface. Each jet typically operates by activating a transducer that causes a drop of ink to be ejected from the jet. FIG. 2 shows an example of one jet from the array.

In FIG. 2, the print head is shown as if it consisted of one jet for ease of discussion. The print head 20 of FIG. 1 is made up of multiples of these jets. Jet 30 may include an inlet channel 31 through which ink 33 travels to the jet. The ink may travel from an ink repository through a series of routing manifolds to arrive at the jet 30. A pressure chamber 35 temporarily stores a small amount of ink.

When the print system controller 10, which may be a microcontroller, microprocessor, or any other component that is capable of executing instructions, determines that the jet needs to expel an ink drop 49 through the aperture 47, the controller generates an electrical signal. This signal is received by the electrodes 43 that then cause the transducer 41 to operate. When the transducer operates in this embodiment, it causes the membrane 37 to flex. This in turn causes the ink in the chamber 35 to travel down the ink outlet 45 and ultimately be expelled through the aperture. It must be noted that the term 'transducer' as used here means any type of actuator that causes ink to expel ink drop through the aperture 47. A transducer is any device that converts an electrical signal to some sort of mechanical action. For example, a piezoelectric transducer receives an electrical signal that causes the transducer to vibrate against a diaphragm, which in turn causes the membrane to pull ink into a chamber and then expel it out the jet. In a bubble jet printer, the transducer is a resistor that receives a signal, heats up and causes a bubble to form in the ink, pushing ink out the jet. These are just examples, with the understanding that any device that causes ink to exit the aperture is considered a transducer.

It has been discovered that the velocity of drops from the outer rows of the jets slow down over the first few months of operation. This causes a greater delay in the drops reaching the printing surface, moving the corresponding row of ink drops to be further 'up' on the drum than they would otherwise be, because the drum is moving down past the array. This causes the ink drops from the outer rows of jets to be separated from the other rows of ink drops by a different gap than the other rows of ink drops are separated from each other, leading to objectionable artifacts in the print image such as blurry or fuzzy lines. This discussion will refer to this phenomenon as 'thermal drift.'

One solution to the problem of thermal drift involves determining the vertical position of the rows. In this discussion, 'vertical' is in the direction of movement, so in the array of FIG. 1, the array has a vertical or "Y" direction from the top of the page to the bottom, or the reverse. Once the vertical position of the rows is determined, any row that was more than half a pixel distance off from the average vertical position, the entire row was 'moved' a full pixel in the other direction.

This adjustment may not make sense without an explicit understanding of the terminology. A 'pixel' or picture element, as used here, corresponds to an ink drop position on the printed image. A pixel distance then, has the dimensions of an ink drop. The vertical position of the pixels in each row is averaged across the array to determine the average spacing between rows. If a row is more than a half of a pixel off where the average spacing would otherwise dictate where that row would be, the entire row may be moved a full pixel distance in the opposite direction. In other words, if a row was a half a pixel distance or more too low, the row could be 'moved' a full pixel distance up. The example of a movement corresponding to a full pixel is just for ease of understanding, the distance of movement may be a partial pixel distance as well.

In this approach, the jets themselves are not moved. To 'move' a row actually means to adjust the firing interval for that row to fire the jets in that row at a time that is either an interval earlier or later than they would otherwise be fired. On an individual pixel level, each individual jet's timing was adjusted as needed to keep the pixels within some partial pixel distance, such as a half pixel, of the average for the rows. However, if these movements are done without consideration to the effects of thermal drift, then the end result may not be optimal.

Figure 3:
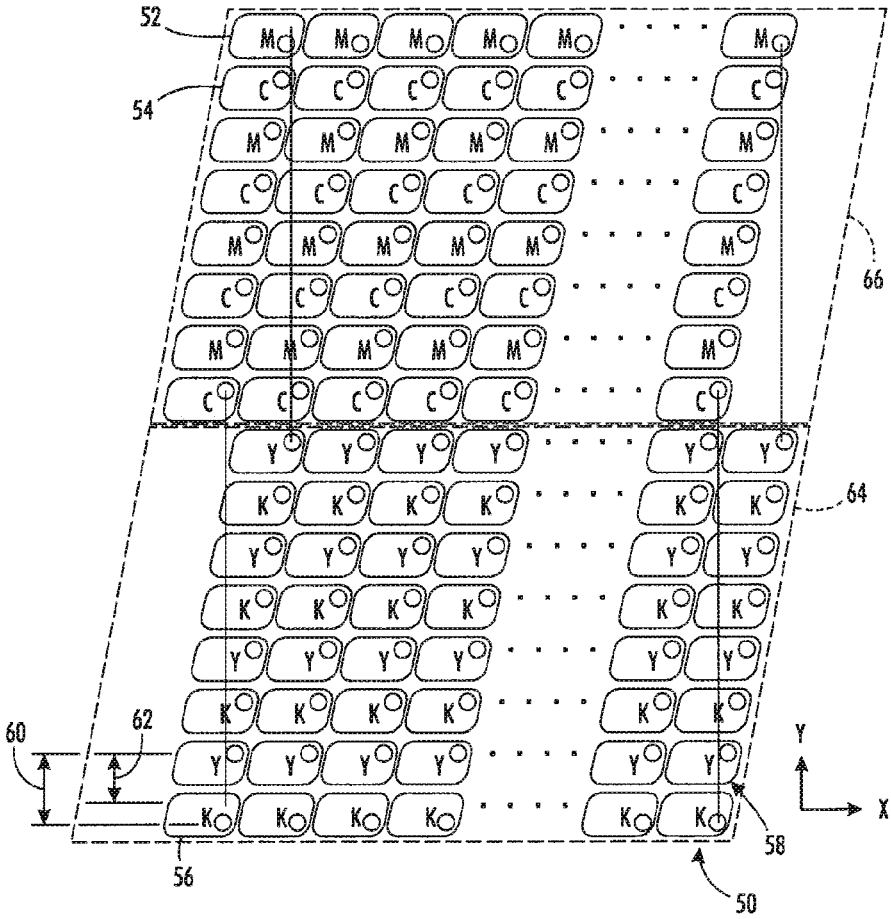
FIG. 3 shows an embodiment of an array of jets having at least one row offset in a vertical direction.

It is possible to use the idea of adjusting the pixel firing interval to move rows up or down as needed, in conjunction with manufacturing the arrays of jets to accommodate thermal drift. FIG. 3 shows an example of such an array.

In array 50, the array has jets for four different colors, magenta (M), cyan (C), yellow (Y) and black (K). In this particular embodiment, the array of jets is divided into two groups each group having two colors, shown here as group 66 have magenta and cyan, and group 64 having black and yellow. This is only an example, and the principles of the invention shown here apply to any configuration of colors or just monochrome printing, such as black. For example, there could be two groups, one for a first color and one for a second color, or one group for a first and second color and one group for a third color.

The array shown here has the outer rows 56, a black row at the bottom of the array, and row 52, a magenta row at the top of the array, offset from the position they would have if the rows were evenly spaced. Looking at the position of row 56, one can see that the gap 60 between the apertures of row 56 and the apertures of row 58 is larger than the gap 62, which is what the gap between the apertures in rows 58 and 56 would be if the rows were evenly spaced.

In this instance, row 56 has been offset in a positive direction, meaning in the direction of the movement between the print head and the printing surface. Referring back to FIG. 1, the direction of movement of the printing surface 36 relative to the array 22 is downwards, so in this example of FIG. 3, positive is downwards. Further, the group of offset apertures in this example consists of a line of jets at the bottom and a line of jets at the top of the array. As mentioned previously, the group of jets may consist of one jet, a single row of jets, several jets in a region that are not in the same row, several lines, etc.

Similar to the movement of row 56, row 52 has also been offset in a positive direction. Note that in the case of the upper, outer row, the offset results in a smaller gap between the rows, where the offset results in a larger gap for the lower outer row.

Unlike the approach mentioned above, this approach actually manufactures the array of jets with this offset positioning. The positions of the jets are actually altered in their physical locations on the aperture plate of the print head. In one example, the jets were located in a position that is 35-45% of a pixel distance different than where they would have been located with even spacing.

Figure 4:
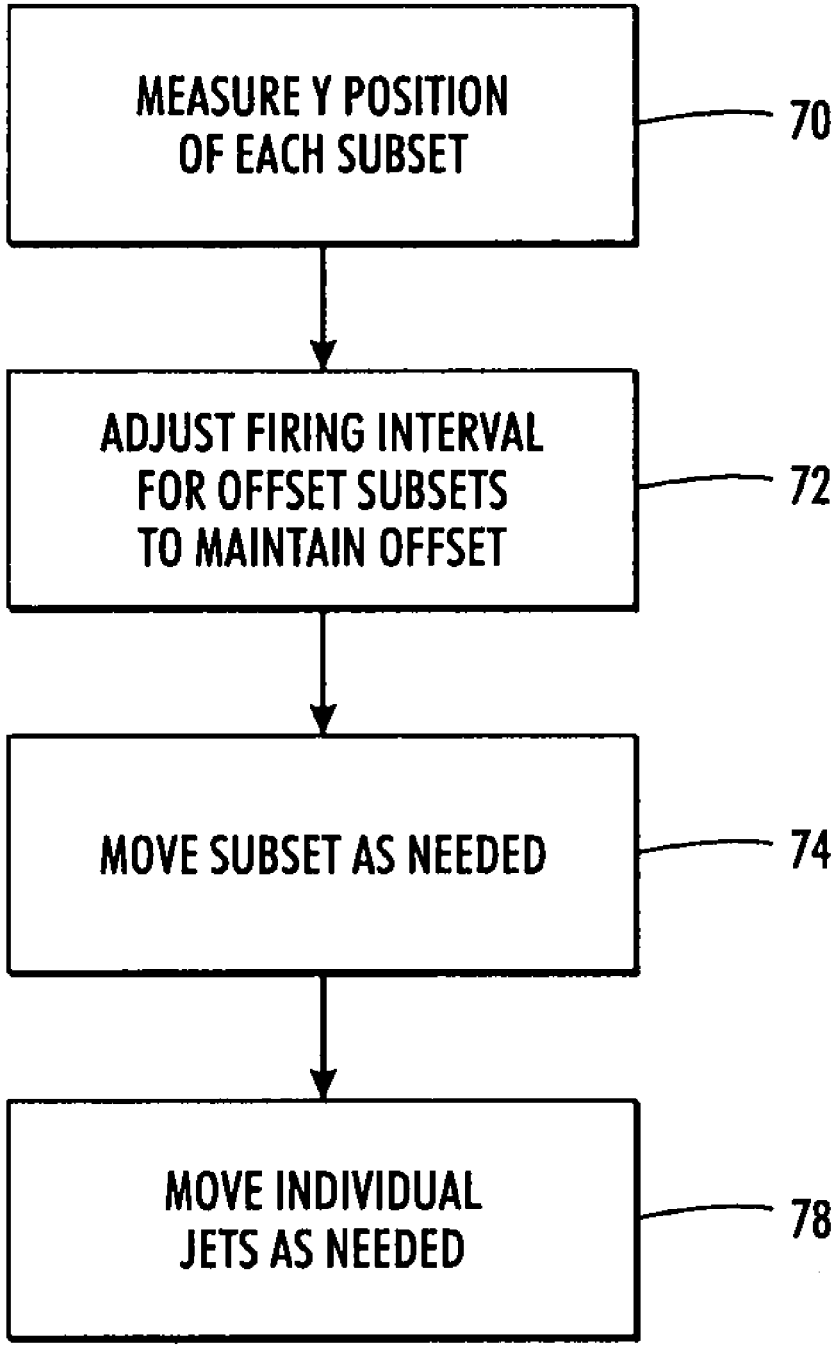
FIG. 4 shows a flow chart of an embodiment of a method to adjust operation of an array of transducers.

The physical adjustment to the array can be combined with instructions executed by the print system controller that differ from the instructions used in the previous approach. FIG. 4 shows a flowchart of an embodiment of the process. The new instructions are similar in that they cause the print system controller to measure the vertical or "Y" position of each group, however defined such as rows, at 70. The instructions then cause the print system controller to adjust the firing intervals of the groups to maintain the offset for the offset group or groups at 72. This may be thought of keeping the offset groups 'positive' or offset in the direction of movement. The groups other than the offset groups are fired at their usual predetermined firing interval. They a kept 'negative.'

It is possible that a group may need to be 'moved' as discussed above to meet a particular print specification. If this needs to occur, it occurs at 74. The individual jets may then be moved as needed to ensure that they fire within a partial pixel of the average position of the group at 78. This occurs whether groups have been moved or not. The previous approach, of moving groups a pixel up or down depending upon whether the group is at least a half pixel from the average, may be applied to the non-offset groups of the array, as needed.

This approach will generally result in the printing system initially adjusting for the physically offset groups to make them closer to their ideal position. Over time, due to the thermal drift, the groups will end up as if they were offset in the other direction, but not enough to be objectionable. They start out too positive to begin with, which is adjusted for by the controller, and end up being slightly too negative, but ideally both situations will be within the operating specifications. This reduces the number of service call and print head replacements. In addition, the controller adjustments could be altered over time to maintain optimal print quality. These alterations may be performed automatically with software instructions that cause the controller to make the alterations or may be adjusted by service personnel in the field.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A print system, comprising:

a print head having an array of jets through which ink can be emitted, the array of jets having at least one subset of the array offset in a vertical direction relative to the other jets;

an array of transducers arranged adjacent the array of jets to cause the jets to emit ink when activated; and a controller electrically coupled to the array of transducers to control the activation of the transducers, the controller to execute software instructions to cause the transducers to activated so as to compensate for the offset subset of jets.

2. The print system of claim 1, wherein the at least one subset offset in a vertical direction is offset a distance of less than one pixel.

3. The print system of claim 1, wherein the array of jets has at least two rows of jets offset in a vertical direction, a first edge row at the bottom of the array of jets and a second edge row at the top of the array.

4. The print system of claim 1, wherein the software instructions cause the transducers to activate so as to compensate for jets that are not offset and have been identified that the jets will drift.

5. The print system of claim 1, wherein the print system comprises one of a direct printing or an indirect printing system.

6. The print system of claim 1, wherein the subset of the array comprises one of a row of jets, two rows of jets, a single jet, or a group of jets in a region of the array.

7. A print head, comprising:

an array of transducers;

an ink chamber to store ink arranged adjacent the array of transducers; and an array of jets arranged adjacent the ink chamber such that when selected ones of the array of transducers are activated, ink from the chamber exits a jet corresponding to the selected ones of the transducers, the array of jets having at least one subset of the array offset in a vertical direction in the range of 20% to 80% of a pixel distance relative to the other jets.

8. The print head of claim 7, wherein at least one subset of the array offset in a vertical direction comprises two rows, a bottom edge row and a top edge row.

9. The print head of claim 7, wherein the subset of the array offset in a vertical direction is offset a distance corresponding to less than three pixels.

10. The print head of claim 7, wherein the at least one subset of the array offset in a vertical direction is offset in a direction corresponding to a direction of movement between the print head and a printing surface.

11. A method of printing, comprising:

executing a software instruction using a print system controller to measure a vertical position of each row of an array of jets, having at least one offset subset of the array offset in a movement direction;

adjusting timing of firing intervals for the offset subset such that the offset subset fire after a longer interval than other jets; and firing jets other than the offset subset at a predetermined firing interval.

12. The method of printing of claim 11, wherein the offset subset comprises one of: two rows of jets one on a top edge and one on a bottom edge of the array of jets; a single jet; a group of jets corresponding to a region on the array; at least one group of jets corresponding to colors.

13. The method of printing of claim 12, wherein the offset subset comprises a least one group of jets corresponding to colors and the offset subset is arranged to have four subsets, a first subset for a first and second color and a second subset for a third and fourth color.

14. The method of printing of claim 13, wherein the first subset has a first group of jets offset for each color and the second subset has second group of jets offset for each color.

15. The method of printing of claim 14, wherein the first subset has a third group of jets offset for each color, wherein the first and third groups of offset jets comprises outer rows of the first group.

16. The method of printing of claim 12, wherein the offset subset comprises at least one group of jets corresponding to colors and the offset subset is arranged to have two subsets, one of either one subset for a first color and one subset for a second color, or one subset for a first and second color and one subset for a third color.

17. The method of claim 11, further comprising determining an average position for each subset based upon the vertical position measured.

18. The method of claim 17, further comprising:

re-measuring the vertical position after adjusting timing; and re-adjusting any individual jets within the subset to fire within a partial pixel of the average position.

* * * * *